US010816004B2

(12) United States Patent
Wang

(10) Patent No.: US 10,816,004 B2
(45) Date of Patent: Oct. 27, 2020

(54) CEILING FAN ADAPTABLE TO CYCLIC MOTION

(71) Applicant: AIR COOL INDUSTRIAL CO., LTD., Taichung (TW)

(72) Inventor: Cliff Wang, Taichung (TW)

(73) Assignee: AIR COOL INDUSTRIAL CO., LTD., Taichung (TW)

( * ) Notice: Subject to any disclaimer, the term of this patent is extended or adjusted under 35 U.S.C. 154(b) by 114 days.

(21) Appl. No.: 16/130,336

(22) Filed: Sep. 13, 2018

(65) Prior Publication Data

US 2020/0088205 A1 Mar. 19, 2020

(51) Int. Cl.

| | |
|---|---|
| ***F04D 25/08*** | (2006.01) |
| ***F04D 25/10*** | (2006.01) |
| ***F04D 29/52*** | (2006.01) |
| ***F04D 25/06*** | (2006.01) |

(52) U.S. Cl.

CPC ..... *F04D 25/105* (2013.01); *F04D 25/0606* (2013.01); *F04D 25/088* (2013.01); *F04D 29/522* (2013.01)

(58) Field of Classification Search

None

See application file for complete search history.

(56) References Cited

U.S. PATENT DOCUMENTS 6,042,072 A * 3/2000 Chi-Nan ..... F04D 25/088 248/222.52
6,817,830 B1 * 11/2004 Chen ..... F04D 25/166 415/60
2003/0210982 A1 * 11/2003 Chen ..... F04D 25/088 416/5
2003/0231962 A1 * 12/2003 Gajewski ..... F04D 25/088 417/53
2004/0175281 A1 * 9/2004 Remington ..... F04D 25/088 417/360
2008/0296459 A1 * 12/2008 Frampton ..... F04D 25/088 248/343
2008/0298961 A1 * 12/2008 Frampton ..... F04D 25/088 415/213.1
2008/0298968 A1 * 12/2008 Frampton ..... F04D 25/088 416/170 R
2010/0319885 A1 * 12/2010 Ignon ..... F04D 33/00 165/104.34
2011/0020135 A1 * 1/2011 Itou ..... F04D 25/088 416/244 R (Continued)

*Primary Examiner* — Michael Lebentritt

(74) *Attorney, Agent, or Firm* — Pai Patent & Trademark Law Firm; Chao-Chang David Pai

(57) ABSTRACT

A ceiling fan adaptable to cyclic motion includes a power unit pivotally connected with a support unit via a transmission unit. The power unit is fixedly provided with a ceiling fan housing, which has a topside and a bottom side respectively provided with an opening and a through hole, the through hole corresponding to a rotating shaft of the power unit. When the ceiling fan is operated, the power unit will pivotally turn along the support unit and drive the blade unit to rotate and actuate the air around to blow toward the front of the blade unit along the periphery of the ceiling fan housing. By so designing, the interior of the ceiling fan is not easy to accumulate batting and dust, and heat of the power unit can be exhausted through the opening at the topside of the ceiling fan housing.

9 Claims, 6 Drawing Sheets

(56) References Cited

U.S. PATENT DOCUMENTS

| | | | | |
|---|---|---|---|---|
| 2013/0136632 | A1* | 5/2013 | Stocks | F04D 25/088<br>417/410.1 |
| 2013/0309068 | A1* | 11/2013 | Liu | F01D 5/02<br>415/123 |
| 2016/0111816 | A1* | 4/2016 | Walker | H01R 13/26<br>417/423.7 |
| 2017/0101998 | A1* | 4/2017 | Yamamoto | F04D 29/023 |
| 2018/0340646 | A1* | 11/2018 | Mehdi | F16M 13/022 |
| 2019/0063447 | A1* | 2/2019 | Wang | F04D 19/002 |
| 2019/0131751 | A1* | 5/2019 | McCurry | H01R 33/46 |
| 2019/0242392 | A1* | 8/2019 | Whitmire | F04D 29/388 |

* cited by examiner

CEILING FAN ADAPTABLE TO CYCLIC MOTION

BACKGROUND OF THE INVENTION

1. Field of the Invention

This invention relates to heat dissipation structure of a ceiling fan, particularly to a ceiling fan adaptable to cyclic motion.

2. Description of the Prior Art

A conventional ceiling fan, as shown in FIG. 1, includes a support 1 and a ceiling fan housing 2. A motor 3 is installed in the ceiling fan housing 2 and formed with a rotating shaft 4, which has one end firmly connected with a blade unit 5 and another end pivotally connected with the support 1 by means of a gear reduction mechanism 6 and a connecting rod 7. The ceiling fan housing 2 consists of a first housing 2*a* and a second housing 2*b*. The first housing 2*a* is fixedly combined with the support 1 and second housing 2*b* is secured with the motor 3 and a grating blade cover 8, and the first housing 2*a* has a part alternately obstructed by the second housing 2*b*. Thus, when the ceiling fan is operated, the rotating shaft 4 of the motor 3 will drive the blade unit 5 to rotate and simultaneously, the rotating shaft 4 of the motor 3 will drive the gear reduction mechanism 6 and the connecting rod 7 to actuate the motor 3, the blade unit 5, the second housing 2*b* and the grating blade cover 8 to rotate relative to the support 1.

FIG. 2 shows a state of air flow when the conventional ceiling fan is operated. After the ceiling fan is operated, the blade unit 5 will guide air to flow from the rear of the ceiling fan to the front of the blade unit 5 and meanwhile, the blade unit 5 will further guide air to flow from the rear of the first housing 2*a* to pass through the gap between the first housing 2*a* and the second housing 2*b* and get into the ceiling fan housing 2 and then, the air will be exhausted by the blade unit 5. By so designing, the conventional ceiling fan is likely to have batting and dust attracted to the gap between the first housing 2*a* and the second housing 2*b* and clogged therein. Thus, the ceiling fan housing 2 will be covered with dirt and heat dissipation of the motor 3 will be poor. Moreover, the top of the ceiling fan housing 2 is an enclosed housing, and heat of the motor 3 will be accumulated from bottom to top via air and as a result, the ceiling fan housing 2 will be impossible to effectively exhaust heat of the motor 3 and the motor of the conventional ceiling fan will get out of order.

SUMMARY OF THE INVENTION

The objective of this invention is to offer a ceiling fan adaptable to cyclic motor, able to reduce accumulation of batting and dust and having good effect in heat dissipation.

The ceiling fan adaptable to cyclic motor in the present invention includes a support unit, a transmission unit, a power unit, a blade unit and a ceiling fan housing. The power unit is pivotally connected with the support unit via the transmission unit and provided with a first motor formed with a rotating shaft. The blade unit is fixedly connected with the rotating shaft of the first motor. The ceiling fan housing secured with the power unit has its interior formed with an accommodating space for receiving the power unit and its top provided with an opening, with a part of the ceiling fan inserted in the opening. Further, the ceiling fan housing has a bottom bored with a through hole corresponding to the rotating shaft of the first motor.

When the ceiling fan of this invention is operated, the power unit and the ceiling fan housing will be actuated by the transmission unit to turn pivotally along the support unit, and the rotating shaft of the first motor will drive the blade unit to rotate. Further, heat of the power unit will accompany air to blow from bottom to top and then will be exhausted through the opening of the ceiling fan housing and simultaneously, the rotation of the blade unit will actuate air and heat at the rear of and around the ceiling fan housing to blow toward the front of the blade unit along the periphery of the ceiling fan housing. Thus, the interior of the ceiling fan housing has good effect in heat dissipation and is not easy to accumulate batting and dust.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
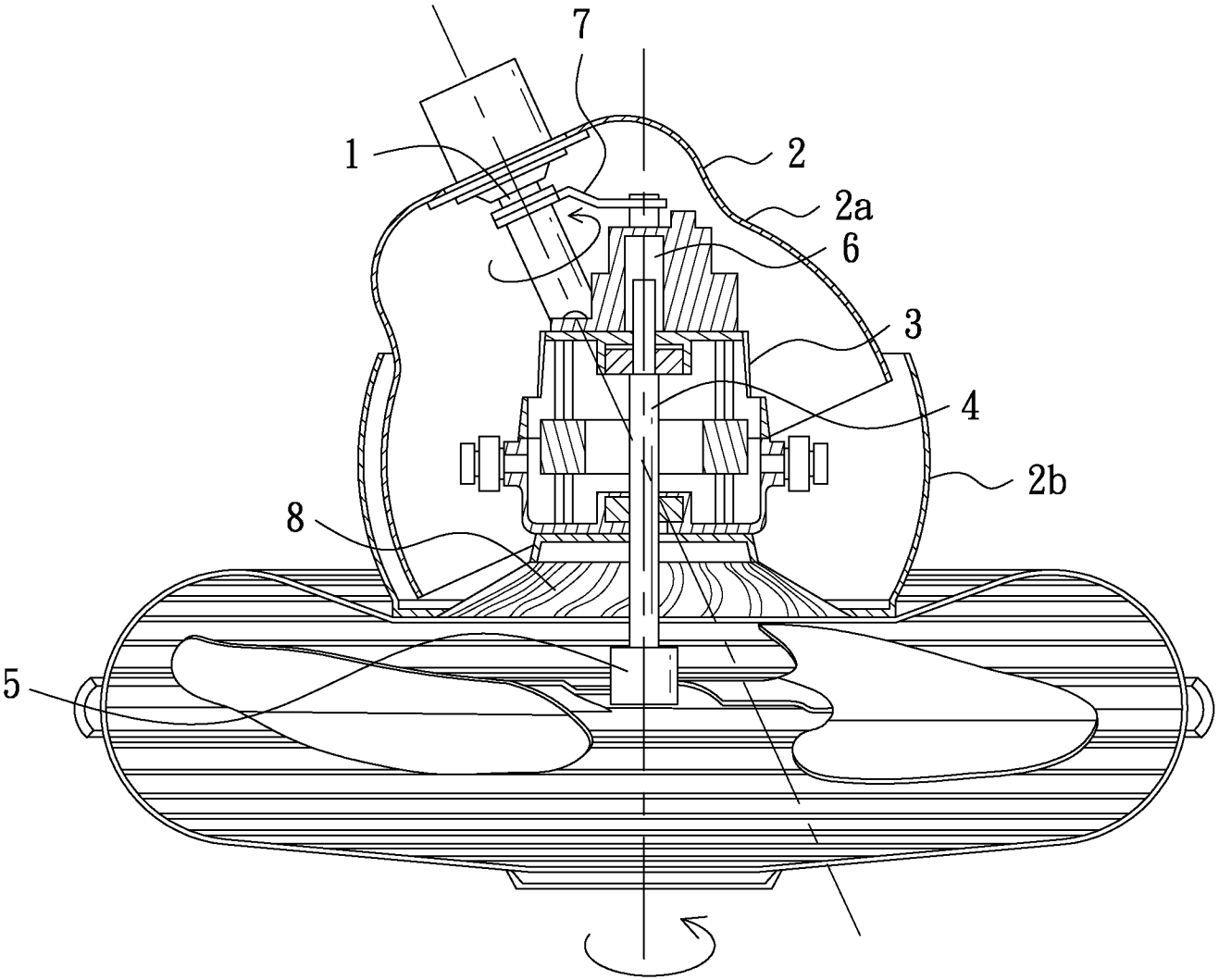
FIG. 1 is a schematic view showing an operation state of a conventional ceiling fan.
Figure 2:
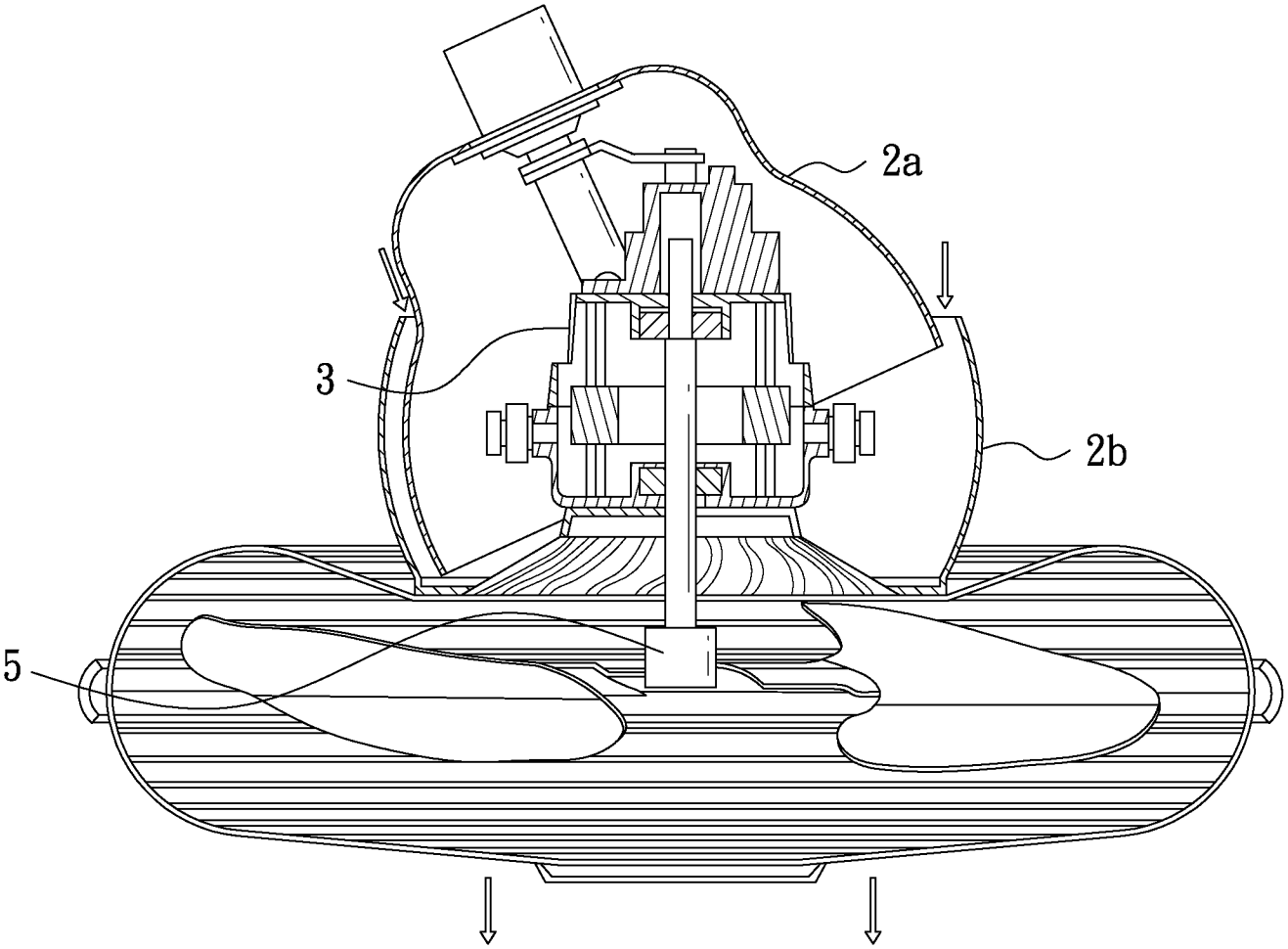
FIG. 2 is a schematic view showing an air flow state when the conventional ceiling fan is operated.
Figure 3:
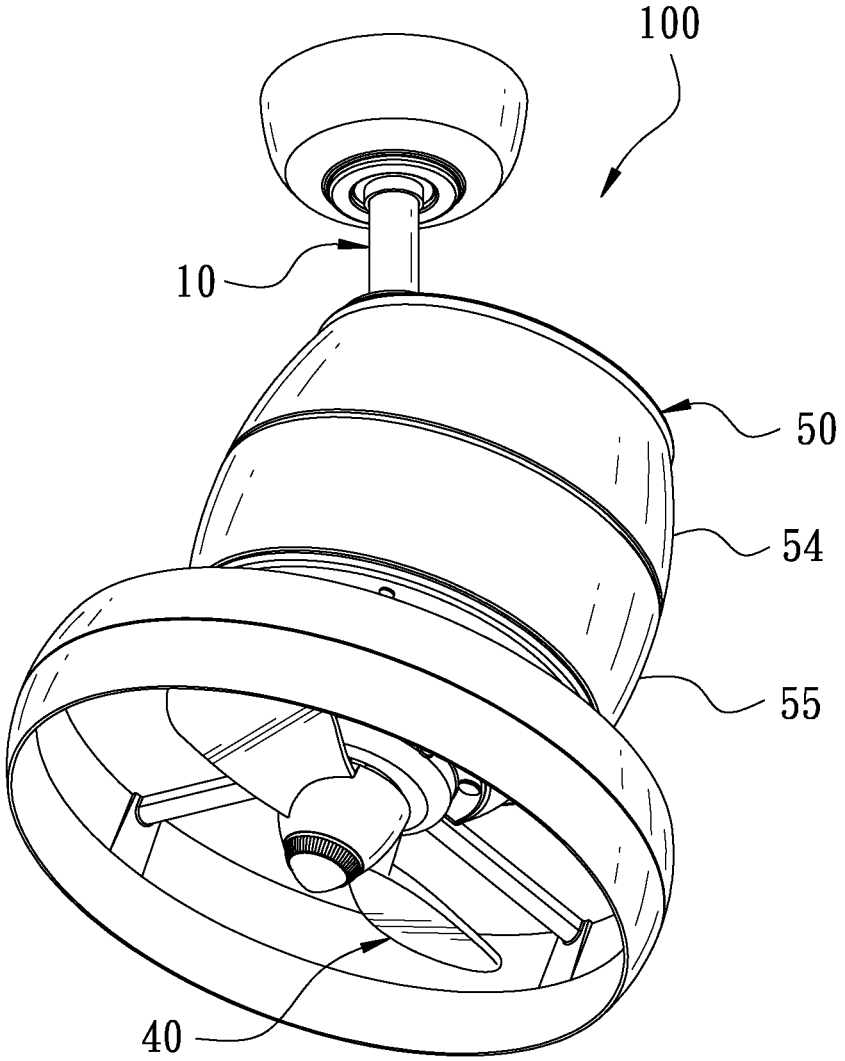
FIG. 3 is a perspective view of a ceiling fan adaptable to cyclic motion in the present invention.
Figure 4:
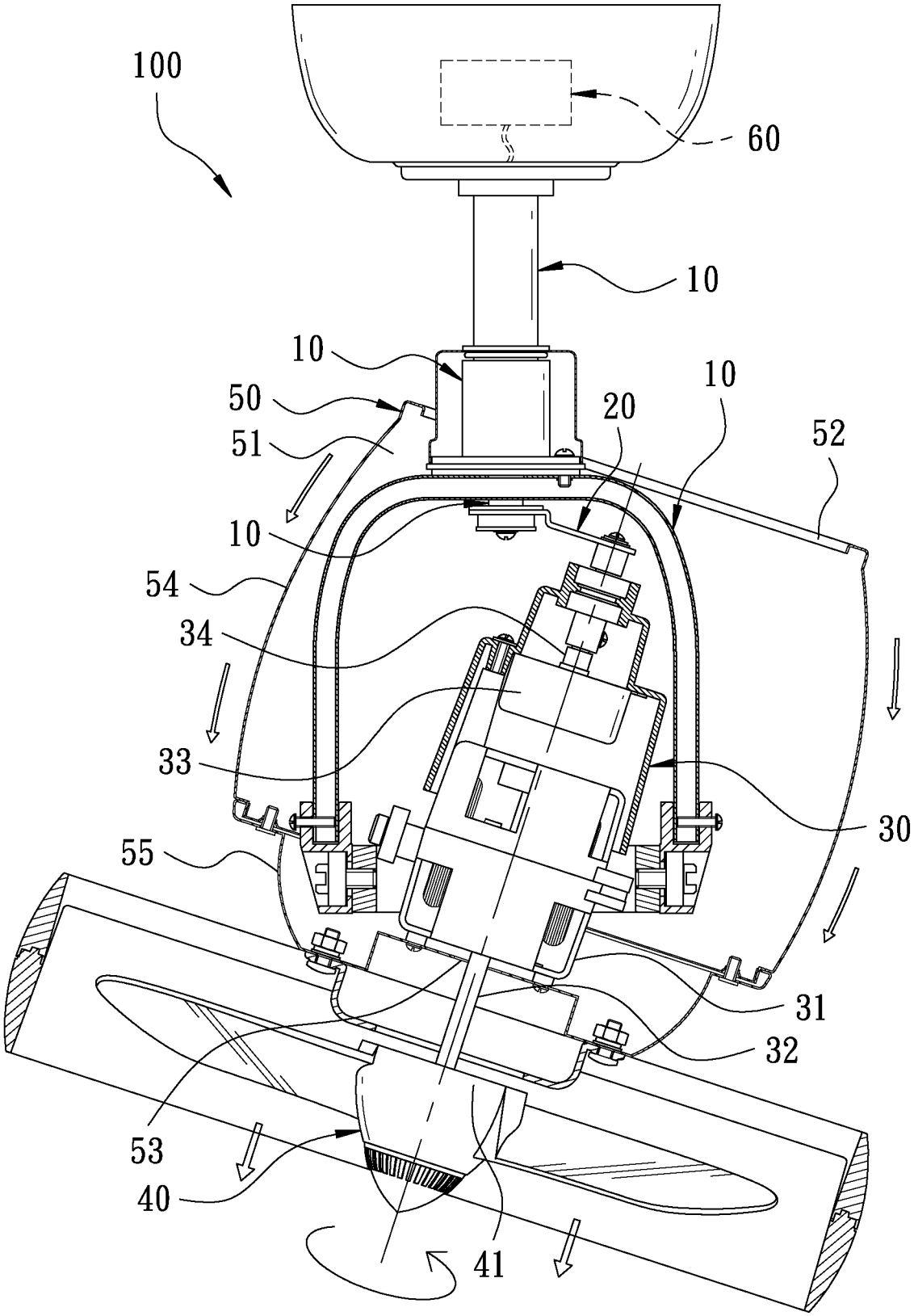
FIG. 4 is a schematic view of the ceiling fan adaptable to cyclic motion in the present invention, showing a state that a first motor drives a blade unit to rotate.

A preferred embodiment of a ceiling fan 100 adaptable to cyclic motion in the present invention, as show in FIGS. 3 and 4, includes a support unit 10, a transmission unit 20, a power unit 30, a blade unit 40, a ceiling fan housing 50 and a wireless receiving controller 60 as main components combined together.

The support unit 10 can be formed integrally or composed of several components or made of different components. In this preferred embodiment, the support unit 10 is composed of different components.

The transmission unit 20 is composed of bearings and connecting rods.

The power unit 30 is pivotally connected with the support unit 10 via the transmission unit 20. The power unit 30 is provided with a first motor 31 formed with a rotating shaft 32, which slants to the horizontal plane. The power unit 30 is further fixed with a second motor 33 formed with a rotating shaft 34, and the power unit 30 is pivotally connected with the support unit 10 via both the rotating shaft 34 of the second motor 33 and the transmission unit 20. Furthermore, one side of the support unit 10, adjacent to the power unit 30, is two-arm shaped and the power unit 30 is provided between the two-arm shaped support unit 10.

The blade unit 40 is firmly connected with the rotating shaft 32 of the first motor 31 and formed with a screening portion 41 at a location adjacent to the rotating shaft 32 of the first motor 31.

The ceiling fan housing 50 secured with the power unit 30 is formed in the interior with an accommodating space 51, and the power unit 30 is received in the accommodating space 51 of the ceiling fan housing 50. The ceiling fan housing 50 has a topside provided with an opening 52 for a part of ceiling fan 100 to be inserted therein and inserted out. To be stated more specifically, in this preferred embodiment, the support unit 10 has a part inserted in the opening 52. Further, the ceiling fan housing 50 has a bottom side bored with a through hole corresponding to the rotating shaft 32 of the first motor 31, and the hole 53 is smaller than the screening portion 41 and is covered by the screening portion 41. The ceiling fan housing 50 contains an upper housing 54 and a lower housing 55 combined together. The lower housing 55 is fixed with the power unit 30, provided at a location adjacent to the rotating shaft 32 of the first motor 31 and bored with the through hole 53 corresponding to the rotating shaft 32 of the first motor 31 for the rotating shaft 32 of the first motor 31 to be inserted therethrough, while the upper housing 54 is firmly mounted on the lower housing 55 and provided with the opening 52.

The wireless receiving controller 60 is electrically connected with both the first motor 31 and the second motor 32.

In use, referring to FIG. 4, a user can make use of a wireless remote controller to control the wireless receiving controller 60 to start the first motor 31 of the ceiling fan 100 and make the rotating shaft 32 of the first motor 31 drive the blade unit 40 to rotate for actuating air at the rear of and around the ceiling fan housing 50 to blow toward the front of the blade unit 40 along the periphery of the ceiling fan housing 50.

Since the through hole 53 of the lower housing 55 corresponds to the rotating shaft 32 of the first motor 31, and the through hole 53 is smaller than the screening portion 41 of the blade unit 40 and is covered by the screening portion 41; therefore, the air in the interior of the ceiling fan housing 50 is almost unaffected by the blade unit 40. Moreover, after the blade unit 40 is operated, the blade unit 40 will guide the air at the rear of and around the ceiling fan housing 50 to blow toward the front the blade unit 40 along the periphery of the ceiling fan housing 50, therefore, the interior of the ceiling fan housing 50 is not easy to accumulate batting and dust.

Figure 5:
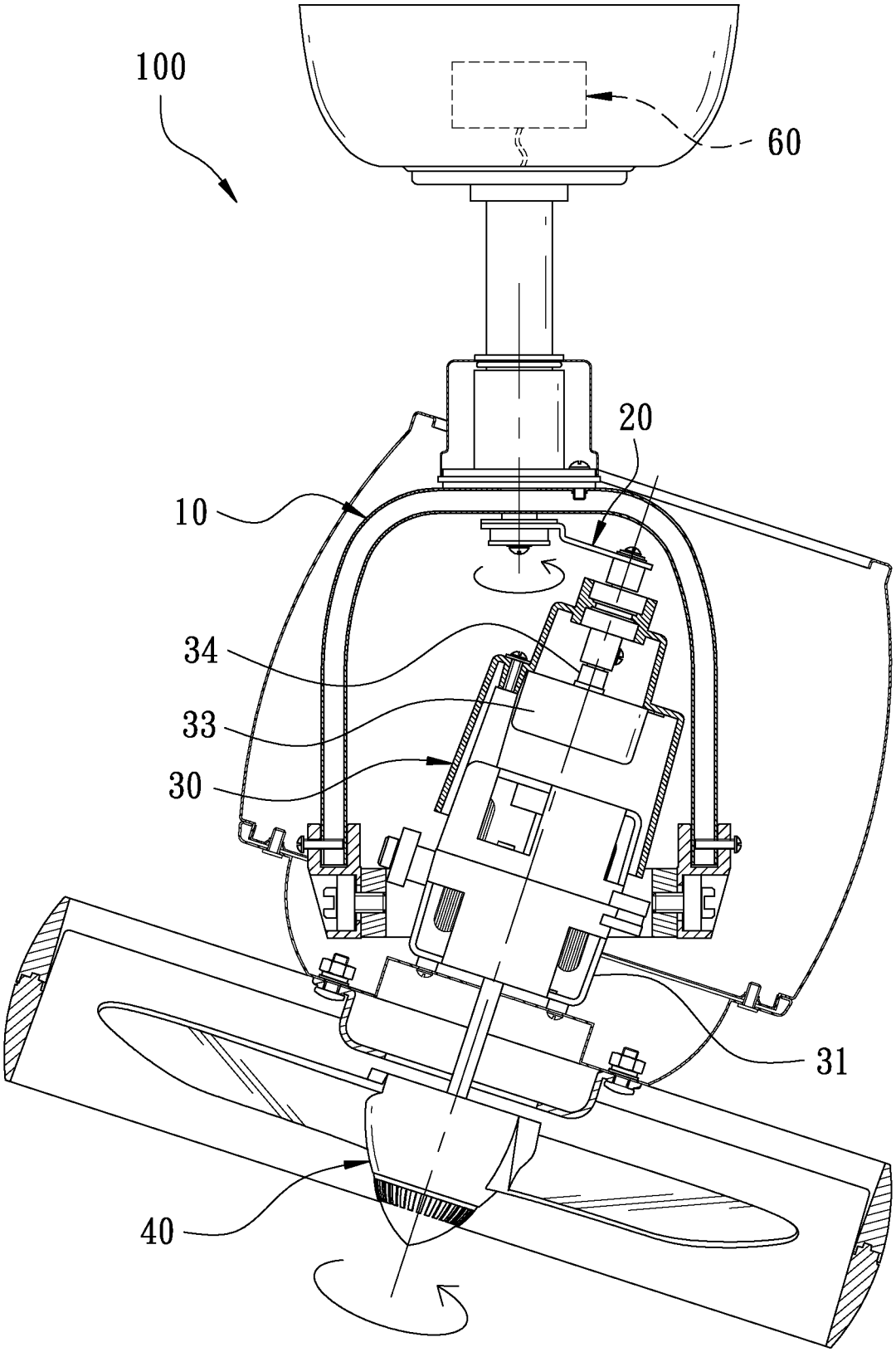
FIG. 5 is a schematic view of the ceiling fan adaptable to cyclic motion in the present invention, showing a state that a second motor drives a power unit to rotate pivotally along a support unit.

FIG. 5 shows a state that the second motor 33 drives the power unit 30 to rotate pivotally along the support unit 10. When the blade unit 40 of the ceiling fan 100 is to be stopped operating or started to operate, a user can make use of the wireless receiving controller 60 to control and start the second motor 33 of the ceiling fan 100 for actuating the rotating shaft 34 of the second motor 33 to drive the transmission unit 20 to turn and make the power unit 30, the ceiling fan housing 50 and the blade unit 40 rotate pivotally relative to the support unit 10. In addition, when the power unit 30 is pivotally rotated to an angle anticipated by the user, the second motor 33 can be controlled to stop operating at any time by means of the wireless receiving controller 60, only maintaining the first motor 31 and the blade unit 40 to be operated.

Figure 6:
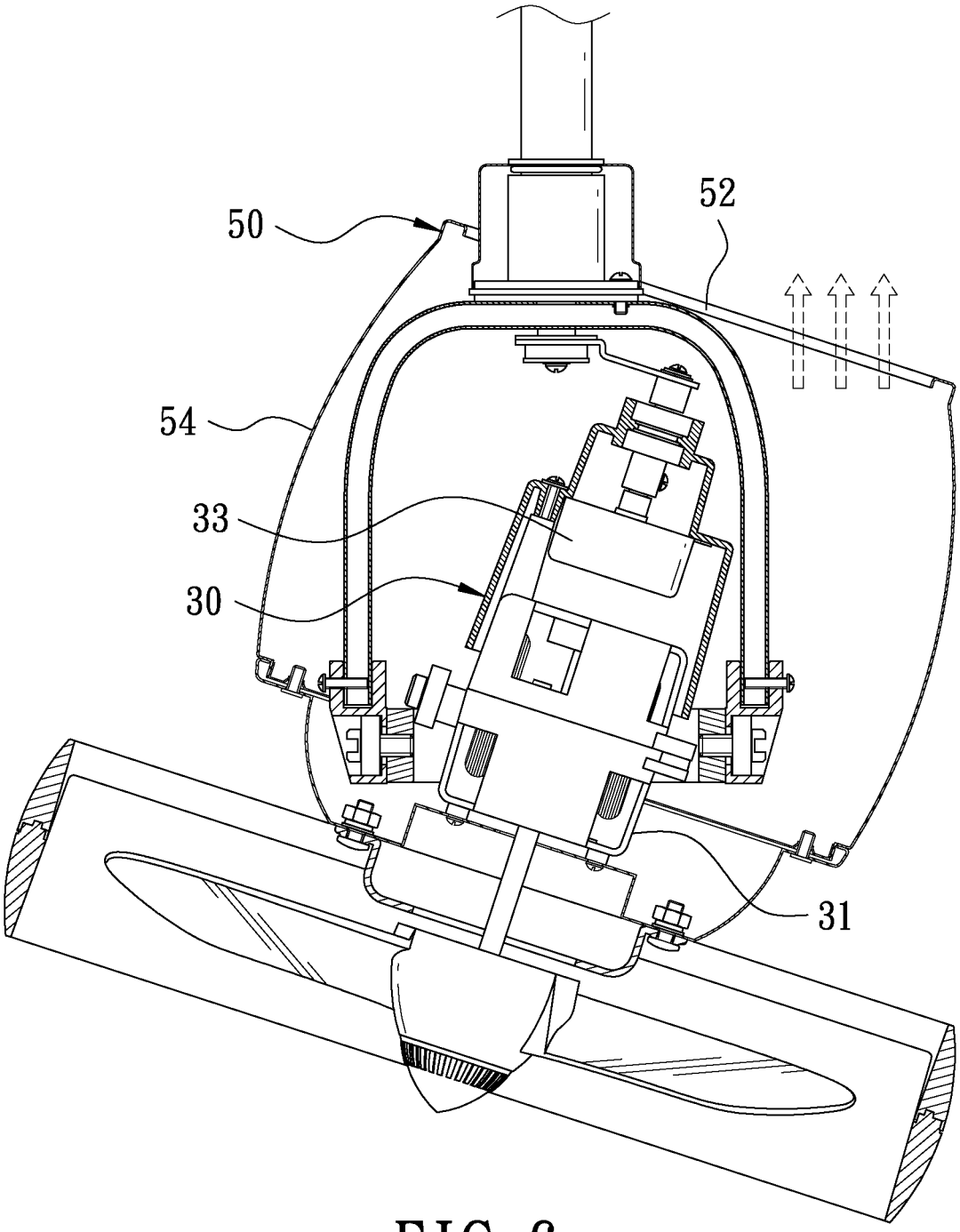
FIG. 6 is a schematic view of the ceiling fan adaptable to cyclic motion in the present invention, showing a state that heat of the power unit is exhausted.

FIG. 6 shows a state of exhausting heat of the power unit 30. Since air is a medium for heat energy to carry out heat conduction; therefore, heat and air are combined and converted into hot air, which moves upward from below in a state of hot air. The upper housing 54 at the upper side of the ceiling fan housing 50 is provided with the opening 52 so that heat of the power unit 30 can be moved upward from below by air and then exhausted via the opening 52, having good effect of heat dissipation. Furthermore, when the blade unit 40 is rotated, air and heat at the rear of and around the ceiling fan housing 50 will be actuated to blow toward the front of the blade unit 40 along the periphery of the ceiling fan housing 50 and thus, the interior of the ceiling fan housing 50 has better effect of heat dissipation and is not easy to accumulate batting and dust.

While the preferred embodiment of the invention has been described above, it will be recognized and understood that various modifications may be made therein and the appended claims are intended to cover all such modifications that may fall within the spirit and scope of the invention.

What is claimed is:

1. A ceiling fan adaptable to cyclic motion comprising:

a support unit having a supporting rod at an upper side;

a transmission unit;

a power unit pivotally connected with the supporting rod of said support unit via said transmission unit, said power unit provided with a first motor, said first motor formed with a rotating shaft;

a blade unit fixedly connected with the rotating shaft of said first motor; and a ceiling fan housing secured with said power unit, said ceiling fan housing provided therein with an accommodating space, said accommodating space of said ceiling fan housing receiving said power unit, said ceiling fan housing having a top side provided with an opening, the supporting rod of said support unit passing through said opening, said ceiling fan housing having a bottom side bored with a through hole corresponding to the rotating shaft of said first motor, wherein the rotating shaft of said first motor slants in relation to the supporting rod of the support unit and the opening of said ceiling fan housing is made sufficiently wide, such that when said power unit turns pivotally around the support unit, the ceiling fan housing as a whole turns together with said power unit in a slanted cyclic motion without interference from said support unit, while allowing air in the accommodating space of the ceiling fan housing to freely flow out through the opening for heat dissipation.

2. The ceiling fan adaptable to cyclic motion as claimed in claim 1, wherein said power unit is further fixed with a second motor, said second motor formed with a rotating shaft, said power unit pivotally connected with said support unit via both the rotating shaft of said second motor and said transmission unit.

3. The ceiling fan adaptable to cyclic motion as claimed in claim 2, wherein a wireless receiving controller is further provided, said first motor and said second motor electrically connected with said wireless receiving controller.

4. The ceiling fan adaptable to cyclic motion as claimed in claim 1, wherein said ceiling fan housing comprises an upper housing and a lower housing combined together, said lower housing secured with said power unit, said lower housing mounted at a location adjacent to the rotating shaft of said first motor, said lower housing bored with said through hole corresponding to the rotating shaft of said first motor, said upper housing fixed on said lower housing, said upper housing provided with said opening.

5. The ceiling fan adaptable to cyclic motion as claimed in claim 1, wherein said support unit is formed with two downward-extending arms at a lower side, adjacent to said power unit, and said power unit is positioned between said two downward-extending arms.

6. The ceiling fan adaptable to cyclic motion as claimed in claim 1, wherein said support unit is formed integrally or composed of several components or made of different components.

7. The ceiling fan adaptable to cyclic motion as claimed in claim 1, wherein said transmission unit is composed of bearings and connecting rods.

8. The ceiling fan adaptable to cyclic motion as claimed in claim 1, wherein said blade unit is formed with a screening portion at a location adjacent to the rotating shaft of said first motor, said through hole being smaller than said screening portion, said screening portion having a continuous surface for covering and blocking view of said through hole.

9. The ceiling fan adaptable to cyclic motion as claimed in claim 1, wherein said ceiling fan housing is constructed such that air is able to move in and out only through said opening.

* * * * *